United States Patent [19]

Van Meurs et al.

[11] Patent Number: 4,886,118

[45] Date of Patent: Dec. 12, 1989

[54] CONDUCTIVELY HEATING A SUBTERRANEAN OIL SHALE TO CREATE PERMEABILITY AND SUBSEQUENTLY PRODUCE OIL

[75] Inventors: Peter Van Meurs; Eric P. De Rouffignac; Harold J. Vinegar; Michael F. Lucid, all of Houston, Tex.

[73] Assignee: Shell Oil Company, Houston, Tex.

[21] Appl. No.: 157,349

[22] Filed: Feb. 17, 1988

Related U.S. Application Data

[63] Continuation-in-part of Ser. No. 477,041, Mar. 21, 1983, abandoned, and a continuation-in-part of Ser. No. 658,850, Oct. 19, 1984, abandoned, and a continuation-in-part of Ser. No. 855,575, Apr. 25, 1986, abandoned, and a continuation-in-part of Ser. No. 943,240, Dec. 18, 1986, abandoned.

[51] Int. Cl.[4] ..... C10B 53/06; E21B 43/24; E21B 43/30; E21B 49/00

[52] U.S. Cl. ..... 166/245; 166/57; 166/250; 166/263; 166/271; 166/272; 166/288; 166/302

[58] Field of Search ..... 166/57, 59, 60, 65.1, 166/245, 250, 252, 263, 271, 288, 302, 247; 299/4, 5

[56] References Cited

U.S. PATENT DOCUMENTS

| | | | |
|---|---|---|---|
| 2,472,445 | 6/1949 | Sprong | 219/33 |
| 2,484,063 | 10/1949 | Ackley | 219/33 |
| 2,634,961 | 4/1953 | Ljungstrom | 262/3 |
| 2,670,802 | 3/1954 | Ackley | 166/60 X |
| 2,732,195 | 1/1956 | Ljungstrom | 262/3 |
| 2,780,450 | 2/1957 | Ljungstrom | 166/60 X |
| 2,789,805 | 4/1957 | Ljungstrom | 166/57 X |
| 2,804,149 | 8/1957 | Kile | 166/60 |
| 2,902,270 | 9/1959 | Salomonsson et al. | 262/3 |
| 2,914,309 | 11/1959 | Salomonsson | 262/3 |
| 2,923,535 | 2/1960 | Ljungstrom | 262/3 |
| 2,939,689 | 6/1960 | Ljungstrom | 166/60 |
| 2,954,826 | 10/1960 | Sievers | 166/60 |
| 3,095,031 | 6/1963 | Eurenius et al. | 158/99 |
| 3,105,545 | 10/1963 | Prats et al. | |
| 3,106,244 | 10/1963 | Parker | |
| 3,113,620 | 12/1963 | Hemminger | 166/247 X |
| 3,113,623 | 12/1963 | Krueger | 166/59 |
| 3,114,417 | 12/1963 | McCarthy | 166/60 |
| 3,131,763 | 5/1964 | Kunetka et al. | 166/60 |
| 3,137,347 | 6/1964 | Parker | |
| 3,139,928 | 7/1964 | Broussard | |
| 3,142,336 | 7/1964 | Doscher | |
| 3,149,672 | 9/1964 | Orkiszewski et al. | 166/60 X |
| 3,163,745 | 12/1964 | Boston | 219/277 |
| 3,164,207 | 1/1965 | Thessen et al. | |

(List continued on next page.)

FOREIGN PATENT DOCUMENTS

| | | |
|---|---|---|
| AU 86 66317 | 9/1988 | Australia |
| 123136 | 12/1941 | Sweden |
| 121737 | 4/1948 | Sweden |
| 123137 | 9/1948 | Sweden |
| 123138 | 9/1948 | Sweden |
| 125712 | 8/1949 | Sweden |
| 126674 | 9/1949 | Sweden |

OTHER PUBLICATIONS

"Underground Shale Oil Pyrolysis According to the Ljungstroem Method," G. Salomonsson, Swedish Shale Oil Corp., IVA, vol. 24, (1953), No. 3, pp. 118–123.

"Net Energy Recoveries for the In Situ Dielectric Heating of Oil Shale," J. E. Bridges, A. Taflove, and R. H. Snow, IIT Research Institute, Chicago, Oil Shale Symposium Proceedings, 1978.

*Primary Examiner*—George A. Suchfield

[57] ABSTRACT

Shale oil is produced from a subterranean interval of oil shale, where the interval is initially substantially impermeable and contains a specified grade and thickness of oil shale. Said interval is conductively heated from borehole interiors which are kept hotter than about 600° C. and are heated at a rate such that kerogen pyrolysis products formed within the oil shale create and flow through horizontal fractures which subsequently extend into fluid-producing wells that are positioned in specified locations.

39 Claims, 8 Drawing Sheets

U.S. PATENT DOCUMENTS 3,182,721 5/1965 Hardy ..... 166/251 X
3,191,679 6/1965 Miller .
3,205,946 9/1965 Prats et al. .
3,207,220 9/1965 Williams ..... 166/60
3,208,531 9/1965 Holland et al. .
3,237,689 3/1966 Justheim ..... 166/247 X
3,246,695 4/1966 Robinson .
3,250,327 5/1966 Crider .
3,284,281 11/1966 Thomas .
3,338,306 8/1967 Cook .
3,342,267 9/1967 Cotter et al. ..... 166/60
3,379,252 4/1968 Heckler et al. .
3,389,975 6/1968 Van Nordstrand .
3,455,383 7/1969 Prats et al. ..... 299/4 X
3,455,391 7/1969 Matthews et al. ..... 166/303
3,468,376 9/1969 Slusser et al. ..... 166/272
3,501,201 3/1970 Closmann et al. ..... 299/4
3,502,372 3/1970 Prats ..... 299/5
3,507,332 4/1970 Venable et al. ..... 166/292
3,547,192 12/1970 Claridge et al. ..... 166/248
3,547,193 12/1970 Gill ..... 166/248
3,572,838 3/1971 Templeton ..... 299/4
3,595,642 7/1971 Miller ..... 166/292
3,613,785 10/1971 Closmann et al. ..... 166/271
3,616,857 11/1971 Pitkethly et al. ..... 166/299
3,620,300 11/1971 Crowson ..... 166/248
3,630,278 12/1971 Parker ..... 166/247 X
3,757,860 9/1973 Pritchett ..... 166/248
3,807,227 4/1974 Smith ..... 73/154
3,848,671 11/1974 Kern ..... 166/248
3,864,969 2/1975 Smith ..... 73/154
3,874,450 4/1975 Kern ..... 166/248
3,880,235 4/1975 Berry et al. ..... 166/302
3,892,128 7/1975 Smith ..... 73/154
3,916,993 11/1975 Katz ..... 166/248
3,920,072 11/1975 Kern ..... 166/248
3,946,809 3/1976 Hagedorn ..... 166/248
3,948,319 4/1976 Pritchett ..... 166/248
3,954,140 5/1976 Hendrick ..... 166/272
3,958,636 5/1976 Perkins ..... 166/248
3,972,372 8/1976 Fisher et al. ..... 166/248
3,981,187 9/1976 Howell ..... 73/154
3,988,036 10/1976 Fisher et al. ..... 299/5
3,989,107 11/1976 Fisher et al. ..... 166/248
3,994,341 11/1976 Anderson et al. ..... 166/272
4,008,761 2/1977 Fisher et al. ..... 166/248
4,008,762 2/1977 Fisher et al. ..... 166/248
4,010,799 3/1977 Kern et al. ..... 166/248
4,013,538 3/1977 Schneider ..... 204/280
4,037,655 7/1977 Carpenter ..... 166/248
4,067,390 1/1978 Camacho et al. ..... 166/302
4,079,784 3/1978 Howard et al. ..... 166/251
4,084,637 4/1978 Todd ..... 166/245
4,084,638 4/1978 Whiting ..... 166/248
4,084,639 4/1978 Todd ..... 166/248
4,116,273 9/1978 Fisher et al. ..... 166/248
4,135,579 1/1979 Rowland et al. ..... 166/248
4,137,968 2/1979 Howard et al. ..... 166/53
4,140,179 2/1979 Kasevich et al. ..... 166/248
4,140,180 2/1979 Bridges et al. ..... 166/248
4,144,935 3/1979 Bridges et al. ..... 166/248
4,148,359 4/1979 Laumbach et al. ..... 166/263 X
4,193,448 3/1980 Jeambey ..... 166/60
4,193,451 3/1980 Dauphine ..... 166/248
4,196,329 4/1980 Rowland et al. ..... 219/10.81
4,199,025 4/1980 Carpenter ..... 166/248
4,228,853 10/1980 Harvey et al. ..... 166/248
4,289,204 9/1981 Stewart ..... 166/303
4,301,865 11/1981 Kasevich et al. ..... 166/248
4,320,801 3/1982 Rowland et al. ..... 166/248
4,359,091 11/1982 Fisher et al. ..... 166/248
4,359,627 11/1982 Takeichi ..... 219/523
4,375,302 3/1983 Kalmar ..... 299/4
4,384,613 5/1983 Owen et al. ..... 166/256
4,401,162 8/1983 Osborne ..... 166/248
4,412,585 11/1983 Bouck ..... 166/248
4,415,034 11/1983 Bouck ..... 166/302
4,444,258 4/1984 Kalmar ..... 166/261
4,570,715 2/1986 Van Meurs et al. ..... 166/302
4,572,299 2/1986 Van Egmond et al. ..... 166/385
4,585,066 4/1986 Moore et al. ..... 166/385
4,616,705 10/1986 Stegemeier et al. ..... 166/250
4,626,665 12/1986 Fort ..... 219/534
4,640,352 2/1987 Van Meurs et al. ..... 166/245
4,704,514 11/1987 Van Egmond et al. ..... 219/278

CONDUCTIVELY HEATING A SUBTERRANEAN OIL SHALE TO CREATE PERMEABILITY AND SUBSEQUENTLY PRODUCE OIL

RELATED APPLICATIONS

This invention is a continuation-in-part of our patent application Ser. No. 477,041 filed Mar. 21, 1983, now abandoned, our patent application Ser. No. 658,850 filed Oct. 9, 1984, now abandoned, our patent application Ser. No. 855,575 filed Apr. 25, 1986, now abandoned, and our patent application Ser. No. 943,240 filed Dec. 18, 1986, now abandoned, the disclosures of which applications are incorporated herein by reference.

BACKGROUND OF THE INVENTION

This invention relates to recovering oil from a subterranean oil shale by means of a conductive heat drive process. More particularly, the invention relates to treating a relatively thick, and relatively impermeable subterranean oil shale by means of a conductive heating process which both creates a permeable zone within a selected portion of the oil shale and subsequently produces shale oil hydrocarbons.

A permeability-aided type of conductive heat drive for producing oil from a subterranean oil shale was invented in Sweden by F. Ljungstrom. That process, which was invented about 40 years ago, was commercially used on a small scale in the 1950s. It is described in Swedish Pat. Nos. 121,737; 123,136; 123,137; 123,138; 125,712 and 126,674. in U.S. Pat. No. 2,732,195, and in journal articles such as: "Underground Shale Oil Pyrolysis According to the Ljungstrom Method", IVA Volume 24 (1953) No. 3, pages 118 to 123, and "Net Energy Recoveries For The In Situ Dielectric Heating of Oil Shale", Oil Shale Symposium Proceedings 11, page 311 to 330 (1978). In the Swedish process, heat injection wells and fluid producing wells were completed within a permeable near-surface oil shale formation so that there was less than a three-meter separation between the boreholes. The heat injection wells were equipped with electrical or other heating elements which were surrounded by a mass of material, such as sand or cement, arranged to transmit heat into the oil shale while preventing any inflowing or outflowing of fluid. In the oil shale for which the Swedish process was designed and tested, the permeability was such that, due to a continuous inflowing of ground water, a continuous pumping-out of water was needed to avoid wasting energy by evaporating that water.

With respect to substantially completely impermeable, relatively deep and relatively thick oil shale deposits, such as those in the Piceance Basin in the United States, the possibility of utilizing a conductive heating process for producing oil was previously considered to be —according to prior teachings and beliefs— economically unfeasible. For example, in the above-identified Oil Shale Symposium, the Ljungstrom process is characterized as a process which ". . . successfully recovered shale oil by embedding tubular electrical heating elements within high-grade shale deposits. This method relied on ordinary thermal diffusion for shale heating, which, of course, requires large temperature gradients. Thus, heating was very non-uniform; months were required to fully retort small room-size blocks of shale. Also, much heat energy was wasted in underheating the shale regions beyond the periphery of the retorting zone and overheating the shale closest to the heat source. The latter problem is especially important in the case of Western shales, since thermal energy in overheated zones, cannot be fully recovered by diffusion due to endothermic reactions which take place about about 600° C."(page 313).

In substantially impermeable types of relatively thick subterranean oil shale formations, the creating and maintaining of a permeable zone through which the pyrolysis products can be flowed has been found to be a severe problem. In U.S. Pat. No. 3,468,376, it is stated (in Cols. 1 and 2) that "There are two mechanisms involved in the transport of heat through the oil shale. Heat is transferred through the solid mass of oil shale by conduction. The heat is also transferred by convection through the solid mass of oil shale. The transfer of heat by conduction is a relatively slow process. The average thermal conductivity and average thermal diffusivity of oil shale are about those of a firebrick. The matrix of solid oil shale has an extremely low permeability much like unglazed porcelain. As a result, the convective transfer of heat is limited to heating by fluid flows obtained in open channels which traverse the oil shale. These flow channels may be natural and artificially induced fractures . . . On heating, a layer of pyrolyzed oil shale builds adjacent the channel. This layer is an inorganic mineral matrix which contains varying degrees of carbon. The layer is an ever-expanding barrier to heat flow from the heating fluid in the channel." The patent is directed to a process for circulating heated oil shale-pyrolyzing fluid through a flow channel while adding abrasive particles to the circulating fluid to erode the layer of pyrolyzed oil shale being formed adjacent to the channel.

Although the thermal conductivity and thermal diffusivity of many subterranean oil shales are, in fact, relatively similar to those of unglazed porcelain and firebrick, U.S. Pat. No. 3,237,689 postulates that "a rapid advance of a heat front" (Col. 3, line 7) can be obtained by exchanging heat between the oil shale and a nuclear reactor cooling fluid and describes systems for using such reactors either located on the earth's surface or in the oil shale deposit.

U.S. Pat. No. 3,284,281 says (at Col. 1, lines 3–21), "The production of oil from oil shale, by heating the shale by various means such as . . . an electrical resistance heater . . . has been attempted with little success . . . Fracturing of the shale oil prior to the application of heat thereto by in situ combustion or other means has been practiced with little success because the shale swells upon heating with consequent partial or complete closure of the fracture". The patent describes a process of sequentially heating (and thus swelling) the oil shale, then injecting fluid to hydraulically fracture the swollen shale, then repeating those steps until a heat-stable fracture has been propagated into a production well.

U.S. Pat. No. 3,455,383 describes the accumulation of partially depleted oil shale fragments within a flow channel such as a horizontal fracture being held open by the pressure of the fluid within the channel. The patent discloses that if the channel roof is lifted to maintain a flow path above such a layer of depleted shale, the overlying formations must be bent and, without precautions, will bend to an extent causing fractures to extend up to the surface of the earth. The patent is directed to a process of intermittently reducing the pressure on the fluid within such a fracture to allow the weight of the overburden to crush and compact the layer of depleted shale.

In a significant portion of substantially impermeable and relatively thick oil shale deposits, such as those in the Piceance Basin, a valuable resource of aluminum is present in the form of dawsonite. In U.S. Pat. No. 3,389,975, directed to recovering aluminum values from retorted oil shales which have been mined out from such deposits, it is pointed out that, in a substantial absence of water, at temperatures of about 1300° F. the dawsonite is converted to crystalline sodium aluminate. Such a water-free retorting can decompose dolomite in the shale to produce carbon dioxide, calcite, and magnesium oxide so that magnesium oxide combines with part of the silicon dioxide in the shale, in a manner permitting a higher recovery of the aluminum values by a leaching process. U.S. Pat. No. 3,502,372, directed to utilizing solution mining to recover dawsonite, indicates that where the pyrolysis is effected by an aqueous fluid, such as steam or the products of underground combustion, it must be conducted at a low temperature and thus relatively slowly, to avoid converting the dawsonite and other soluble aluminum compounds to an insoluble material such as analcite. In U.S. Pat. No. 3,572,838, a similar relatively low temperature pyrolysis is alternated with injections of an aqueous alkaline fluid containing an acid-insoluble chelating agent to aid in leaching dawsonite without forming such insoluble materials.

SUMMARY OF THE INVENTION

The present invention relates to a process for conductively heating a subterranean oil shale formation in a manner arranged for producing oil from a subterranean oil shale formation which is, initially, substantially impermeable. In accordance with this invention, the portion of oil shale deposit to be treated is selected, on the basis of the variations with depth in the composition and properties of its components, to have properties capable of interacting in a manner which at least maintains the uniformity of the heat fronts and preferably enhances the uniformity of the heat fronts to an extent limiting the time and energy expenditures for producing the oil to values less than the value of the oil which is produced. The selection of the treatment interval is based on the grade and thickness of the portion of oil shale deposit to be treated and the enhancement it provides reduces the amount of heat energy lost due to endothermic side reactions and increases the amount of oil recovered from a given grade of oil shale.

In accordance with this invention at least two wells are completed into a subterranean oil shale treatment interval which is at least about 100 feet thick, is capable of confining fluid, at process pressure, at least substantially within the treatment interval, and contains a grade and thickness of oil shale such that the average grade in gallons of oil plus gas equivalent per ton by Fischer Assay is at least about 10 and the product of the grade times the thickness in feet of the oil shale is at least about 3000. Although it is desirable for the treatment interval to be substantially impermeable, and to contain substantially no mobile water, this invention is also applicable to intervals containing some mobile water, where an influx of additional water can be minimized.

In a location in which a subterranean oil shale may contain portions which are generally suitable for use as a treatment interval, but are apt to be permeated by substantially disconnected natural fractures and/or planes of weakness, as well as being located near boundaries of the oil recovery pattern and/or near a potentially active aquifer, the operation of the present process can advantageously be combined with a use of "guard wells" located near the periphery of the oil recovery pattern and/or between a production well and an aquifer. Such guard wells are extended at least substantially throughout the vertical extent of the treatment intervals and the adjacent formations are initially heated by thermal conduction in a manner similar to that employed in the heat-injecting wells, except that the guard wells are heated at temperatures which are too low to gasify significant proportions of the oil shale organic components, but high enough to cause a significant thermal expansion of the rock matrix of the oil shale deposit.

In some instances, it may be desirable to maintain such a relatively low temperature guard well heating throughout at least a substantial portion of the shale oil recovery process. In other instances, after an initial relatively low temperature heating of the guard wells, it may be advantageous to heat guard wells at about the temperature selected for the heat-injecting wells, in order to expand the pattern of wells from which oil is displaced by thermal conduction.

Where the presence of an aquifer above or below an oil shale treatment interval is a potential source of water influx to the treatment interval, the operation of the present process can be advantageously combined with a use of "buffer zones" between the oil shale treatment interval and the active aquifer. Such a buffer zone is provided by heating the buffer zone by thermal conduction, in a manner similar to that used in the treatment interval, such that thermal expansion occurs within the buffer zone, without mobilizing significant portions of the oil shale organic materials in the buffer zone.

Where there is mobile water present in the target treatment interval, the installation of guard wells and/or buffer zones allows application of the process to such deposits. Once the guard wells and/or buffer zones are installed and heated, thermal expansion will occur in these zones, closing the natural fractures initially present. Water initially present in the treatment interval is then heated and driven off, while an additional influx of water is prevented by the guard wells and/or buffer zones.

In accordance with this invention, wells are completed into the treatment interval and are arranged to provide at least one each of heat-injecting and fluid-producing wells having boreholes which, substantially throughout the treatment interval, are substantially parallel and are separated by substantially equal distances of at least about 20 feet, and preferably 30 feet or more. In each heat-injecting well, substantially throughout the treatment interval, the well-surrounding face of the oil shale formation is sealed with a solid material and/or cement which is relatively heat conductive and substantially fluid impermeable. In each fluid-producing well, substantially throughout the treatment interval, fluid communication is established between the well borehole and the oil shale formation and the well is arranged for producing fluid from the oil shale formation. The interior of each heat-injecting well is heated, at least substantially throughout the treatment interval, at a rate or rates capable of (a) increasing the temperature within the borehole interior to at least about 600° C. and (b) maintaining a borehole interior temperature of at least about 600° C., without causing it to become high enough to thermally damage equipment within the borehole, while the rate at which heat is generated in the borehole is substantially equal to that permitted by the thermal conductivity of the oil shale formation.

Determinations are made of variations with depth in the composition and properties of the oil shale deposit and, in a particularly preferred procedure, based on the variation with depth in the thermal conductivity of the oil shale deposit, the heat-injecting wells are heated so that relatively higher temperatures are applied at depths adjacent to portions of the oil shale deposit in which the heat conductivity is relatively low. In addition, or alternatively, in various situations, the effective radius of at least one heat-injecting well is increased by creating an expanded portion of the well borehole and extending heat-conducting metal elements from within the heated well interior to near the wall of the expanded portion of the borehole.

In a preferred embodiment of the present process, the material for sealing the face of the oil shale formation along the borehole of at least one heat-injecting well is a closed bottom casing grouted by cement arranged to fill substantially all of the space between each outermost metallic element present within the interior of the borehole and the adjacent face of the oil shale formation, with said cement having a thermal conductivity at least substantially as high as that of the oil shale formation.

The present process is valuable for use within a treatment interval of oil shale which contains other valuable minerals such as dawsonite and/or nahcolite. In such a situation the present process creates a permeable zone which is selectively located, within the treatment interval and substantially within the boundaries of the well pattern used for the oil production. The resultant permeable zone is a zone from which such other minerals can be solution-mined.

In general, the present invention is applicable to substantially any subterranean oil shale deposit containing an interval more than about 100 feet thick and an adequate average Fischer Assay grade in gallons per ton to give a grade-thickness product of about 3000 or greater. The average grade of the heated interval should be greater than about 10 gallons per ton (based on Fischer Assay). Within these limitations, a higher grade thickness product is increasingly desirable if other conditions such as depth remain the same.

DESCRIPTION OF THE INVENTION

Figure 1:
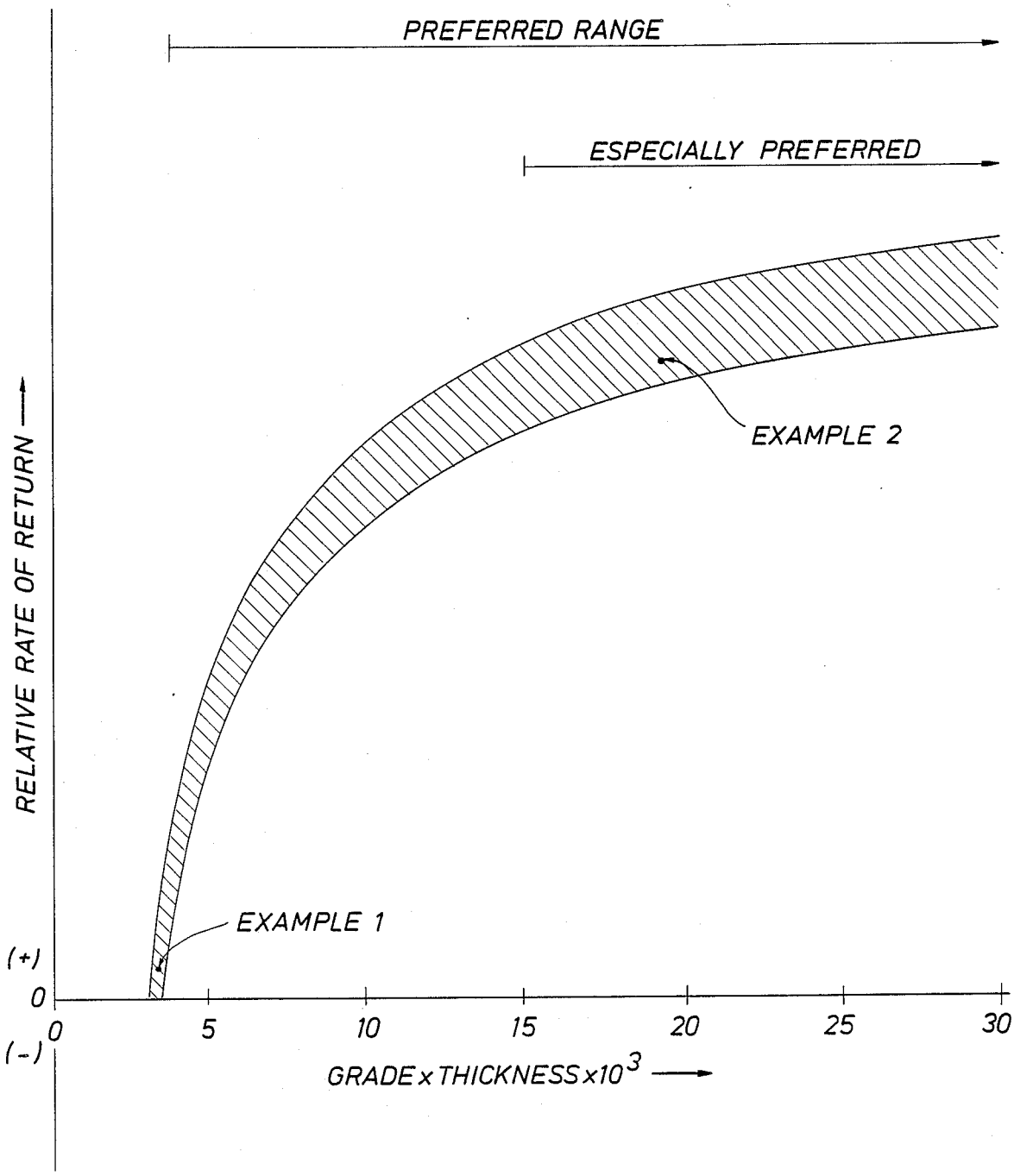
FIG. 1 shows a plot of relative rate of return for 1982 dollars invested in installing and operating the process of the present invention, as a function of oil shale grade-thickness product, to produce shale oil at its 1982 value.

As far as Applicants are aware, the most similar prior process comprises the above-described Swedish process. The Swedish process was designed for and used in a permeable oil shale formation in which the rate of the transmission of heat away from the heat-injecting wells and toward fluid-producing wells was increased by the flow of fluid through a permeable oil shale formation. In that oil shale, as soon as a portion of fluid (such as the ground water and/or kerogen pyrolysis products) became hotter and was thermally pressurized to attain a volume greater than that of a more remote portion of the same fluid, the increasing pressure and volume began to displace the heated fluid away from the heat-injecting well. This caused heat to be transmitted by convection, and thus caused heat to be transmitted at a rate significantly greater than the rate that would be permitted by the heat conductivity of an oil shale formation in which substantially all of the components are immobile. In spite of (or because of) the fact that the heat transmission involved such a flow of fluid and in spite of the fact that the wellbores were separated by less than 9 feet, the Swedish process was found to be economically unfeasible and was terminated.

As indicated by the above-mentioned patents relating to producing oil from substantially impermeable deposits of oil shale, the forming and maintaining of fluid permeable paths between injection and production wells was found to be extremely difficult and expensive. Accordingly, the possibility of applying a process based on the conductive heating of the formation to an impermeable oil shale was considered to be hopeless. Conductive heating was indicated to be too slow and too inefficient to be economically useful, even in the permeable oil shale formation from which some production had been obtained. It appears that a similar opinion may have been shared by the inventor of the Swedish process. His belief that there was a need for a pre-existing permeable zone or channel is exemplified by U.S. Pat. No. 2,780,450. In describing how his previously tested in situ process for pyrolyzing oil shale should be applied to a fluid-impermeable material, such as the Athabasca tar sand, Ljungstrom teaches that the in situ heating and pyrolyzing should be done in a portion of the impermeable formation which is vertically contiguous to a well-interconnecting fracture or a layer which has different geological character and is permeable to flow of the fluid products of the heating or pyrolysis.

Contrary to the implications of such prior teachings and beliefs, applicants discovered that the presently described conductive heating process is economically feasible for use even in a substantially impermeable subterranean oil shale. This is not obvious, particularly in view of the fact that the present process uses a much larger well spacing than that used in the Swedish process and the present process is conducted by heating the injection wells to temperatures of at least about 600° C. (although 600° C. has been said to be conducive to an economically untenable, heat-wasting, endothermic reaction; see the Oil Shale Symposium Proceedings mentioned above).

By means of laboratory and field test measurements and mathematical models of the present process, applicants have found that when the wells are spaced, completed, and operated as presently described, the only region in which heat energy is utilized in an endothermic reaction amounts to less than about 1% of the area to be heated, and the energy lost in that fashion is insignificant. Applicants have measured the rate at which substantially impermeable oil shale formations are heated by conductivity, and have determined the amount of heat required to pyrolyze kerogen and thermally pressurize the pyrolysis products to pressures capable of fracturing a relatively deep oil shale formation and thermally displacing pyrolysis products through the so-created permeability.

The data obtained by such measurements in the field and in the laboratory have been employed in calculations of power requirements, economics, time to start production, project duration, amount of production, etc., in mathematical simulations that correlate with the field and laboratory data and indicate the magnitudes of such factors in respect to a full scale process. Those calculations indicate that the presently defined process is the only shale oil production process of which applicants are aware which is capable of economically obtaining oil from a relatively low grade oil shale formation, such as one in which the Fischer Assay is only 15 gallons or less per ton. This capability can increase the petroleum reserves of a significant proportion of the oil shale lands by a factor of six. In addition, with respect to processes for underground mining and modified in situ reporting of oil shale, the present process significantly increases the amount of available resources by eliminating the need for support pillars and interburden between mining zones and by providing a means for treating substantially all of a very thick interval of oil shale.

FIG. 1 shows the relative rate of return for 1982 dollars invested in installing and operating the present process in field applications that have been mathematically modeled from data obtained by field and laboratory measurements.

Suitable determinations of compositions and properties of the minerals and/or organic components of an oil shale deposit and the variations with depth in such properties can be made by means of known well logging, reservoir sampling, and the like analytical procedures. The determinations can utilize previously measured geophysical or geochemical data or laboratory or core analyses, etc. For example, the variations with depth in the heat conductivity of the adjacent formations can be determined by calculations based on the kinds of amount of materials present, and/or by thermal conductivity logging measurements, etc. U.S. Pat. No. 3,807,227 describes a logging tool containing a constant output heat source and three temperature sensors for obtaining a log of relative thermal conductivity with depth. U.S. Pat. No. 3,892,128 describes logging cased or open boreholes for temperature, specific heat and thermal conductivity, employing a constant output heat source and three temperature sensors. U.S. Pat. No. 3,864,969 describes a logger for making station measurements of thermal conductivity by heating a formation for a time, then measuring the rate at which the temperature decays back to the ambient temperature. U.S. Pat. No. 3,981,187 describes logging thermal conductivity of a cased well by measuring the temperature of the casing wall before and after passing a heated probe along the wall.

The wells used in the present process can be completed by substantially any method for drilling a borehole into and/or opening a pre-existing borehole into fluid communication with the subterranean oil shale formation to be used as an oil shale treatment interval. In addition to having the specified thickness and grade of oil shale, the interval to which the present process is applied should be capable of confining fluid at least substantially within the treatment interval, at least in respect to allowing no significant leakage into overlying locations when the pressure of the fluid reaches process pressure, and fractures the formation within the treatment interval. The boreholes of wells completed for use in the present process should be substantially parallel and separated by substantially equal distances of at least about 20 feet. Borehole separation distances between injectors and producers of from about 30 to 100 feet are particularly suitable. Boreholes free of deviations from parallel which cause variations of more than about 20 percent of the well distances are particularly suitable.

Even with respect to a five-spot pattern in which a single fluid-producing well is surrounded by four heat-injecting wells, substantially all of the intervening oil shale can be both retorted and made permeable. However, the present invention is preferably employed in a series of contiguous seven— or thirteen-spot patterns—in either of which patterns (particularly in the thirteen-spot pattern) and retorting rate is significantly increased by having each fluid-producing well surrounded by six or twelve heat-injecting wells.

In the heat-injecting wells used in the present process, the cement or cement-like material which is used to seal along the face of the oil shale formation is preferably relatively heat-conductive and substantially fluid-impermeable. Particularly preferred cements are stable at temperatures of at least about 800° C., have relatively high thermal conductivities, relatively low permeability, little or no shrinkage, an adequate ease of pumpability and good chemical resistance, etc. The permeability and disposition of the sealing material should provide a seal capable of preventing any significant amount of fluid flow between the interior of the borehole and the face of the oil shale formation, so that the transfer of heat from the well to the formation is substantially entirely by conduction.

In general, the heating of the interior of the heat-injecting well can be accomplished by substantially any type of heating device, such as combustion and/or electrical type of heating elements, or the like. The heating element should extend substantially throughout the treatment interval (preferably throughout at least about 80 percent of that interval). Where a combustion type heating element is used, a gas-fired heater is preferred. The fuel and oxidants for a combustion heater (such as methane and oxygen) are preferably supplied through separate conduits leading through a heat exchanger in which the incoming fluids are heated by the outflowing combustion products. The burner housing and fluid conduits of a combustion heater are preferably installed within a well conduit which is surrounded by an annular space that is filled by the cement for sealing the face of the oil shale. Generally suitable types of combustion heaters which could be arranged for use in the present process are described in U.S. patents such as 2,670,802; 2,780,450 and 2,902,270.

An electrical resistance heater is particularly suitable for heating the interior of a heat-injecting well in the present process. A plurality of resistance elements are preferably used. The resistance elements can be mounted within or external to an internal conduit or rod, or simply extended into the borehole. When the resistances are external to, or are free of a supporting element, such as a conduit or rod, they are preferably embedded in the cement which seals the face of the oil shale along the treatment interval. Generally suitable types of electrical heaters which could be arranged for use in the present process are described in patents such as U.S. Pat. Nos. 2,472,445; 2,484,063; 2,670,802; 2,732,195 and 2,954,826.

In the present process, the rate at which heat is transmitted into the oil shale deposit is strongly affected by the temperature gradient between a heat-injecting well and the surrounding earth formation. In a preferred procedure, the determinations of variations with depth in the composition and properties of the oil shale deposit include a determination of the pattern of heat conductivity with depth within the earth formations adjacent to the heat-injecting well. Based on such determinations the temperatures to which at least one heat-injecting well is heated are arranged to be relatively high at the depths at which the heat conductivities of the adjacent earth formations are relatively low. This tends to cause the rate at which heat is transmitted through the earth formations to be substantially uniform along the axis of the heat-injecting well. Known procedures can be utilized in order to provide higher temperatures in portions of heat injecting wells adjacent to earth formations of relatively low heat conductivity, such as those described in commonly assigned U.S. Pat. No. 4,570,715. For example, in wells which are being heated by electrical resistances, additional resistant elements can be positioned at the location at which extra heating is required, preferably with precautions being taken to avoid the creation of "run-away hot-spots" due to increasing temperature further increasing the resistance and thus further increasing the heating. In wells being heated by combustion, more, or larger, or more heavily fired, burner elements can be positioned in such locations.

Alternatively, the borehole diameter can be enlarged to accommodate one or more heat conductive metal elements, such as a collar, containing a radially extensive element, which will enhance dissipation of heat from the heat injection well. This is being accomplished by underreaming the borehole. Where portions of the heat-injecting well borehole are effectively incrased in diameter near upper and lower extremities of the treatment interval, for example, by underreaming, the diameters of the increased portions are preferably at least about 110% of the nominal borehole diameter. Calcium aluminate-bonded concretes and/or cements containing alumina-silicate aggregates (or fine particles) are particularly suitable for use as such formation face-sealing materials. Examples of suitable cements and concretes include those described in patents such as U.S. Pat. Nos. 3,379,252; 3,507,332 and 3,595,642.

Figure 2:
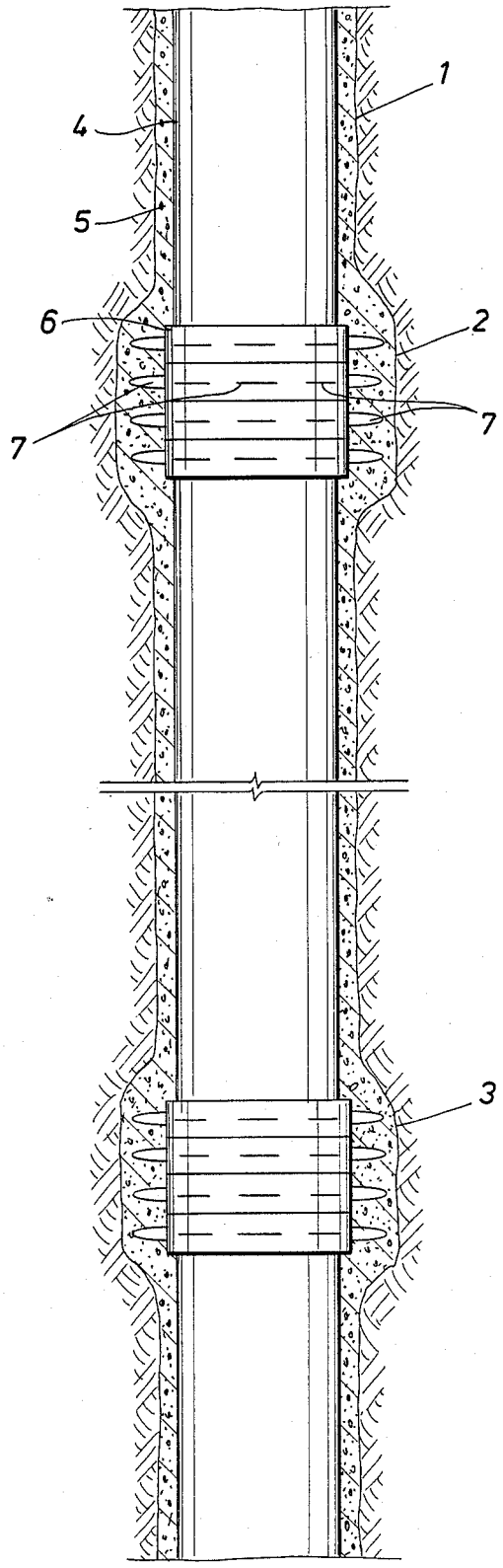
FIG. 2 is a schematic illustration of a portion of a well completion arrangement suitable for practicing the present invention.

FIG. 2 shows a portion of a heat-injecting well borehole, borehole 1, which is suitable for use in the present invention and is located within a treatment interval of subterranean oil shale deposit. Borehole 1 contains enlarged portions, such as portions 2 and 3, which can be formed by conventinal procedures, such as underreaming during drilling. A casing 4 is shown positioned within the borehole and cemented into place with a fluid-impermeable, heat-conductive material, such as cement 5. Within each enlarged borehole portion, the casing 4 is equipped with at least one heat-conductive metal element, such as collar 6, containing radially extensive elements or portions, such as flexible metal members 7. Such heat-conductive materials form relatively highly conductive paths for conducting heat from within the interior of a borehole to substantially the wall of an enlarged portion of the borehole. Examples of suitable heat-conductive metal elements include metal wall scratchers, turbulence inducers, centralizers and the like such as a Hammer-Lok Turbobonder, or Boltlok Turbobonder, available from Bakerline division of Baker Oil Tools or a 101 Bar S centralizer available from Antelope Oil Tool and Manufacturing Company, etc.

With an arrangement of the type shown in FIG. 2, at least to some extent, the front of heat transmitted away from a heat-injecting well can be made more uniform along a vertical line traversing a layer of relatively low heat conductivity without the necessity of maintaining a higher temperature in the portion of the well adjacent to that layer. When a uniform temperature is maintained within the interior of the borehole, the earth formation face along such an enlarged portion of the borehole becomes heated to substantially the same temperature as the formation face along narrower portions of the borehole. Since the face of the formation adjoining the borehole is heated to the highest temperature of any portion in the formation, the temperature gradient extending radially away from the enlarged portion of the borehole is shifted radially away from the borehole.

During the presently described thermal conduction process, a significant fraction of the oil shale formation is at temperatures conducive to conversion of kerogen to liquid and gaseous hydrocarbon products. The composition of these fluids is determined by the temperature of the rock and by their residence time at high temperature (say greater than 275° C.). The rock temperature is determined by the temperatures of the heaters, the well pattern, and by formation properties, such as thermal conductivity and heat capacity. All of these parameters are substantially fixed in the sense that once the process is started it would be difficult, if not impossible, to change them. The residence time of the liquid reaction products, however, is a variable that, to a certain extent, can be controlled independently by pumping, or otherwise producing, the production wells slower or faster.

As an extreme example, examine the case of the Swedish in situ process as carried out in the 1940s and 1950s. The production wells in that process application were not equipped with pumps, so that only hydrocarbon vapors (and steam) were produced to the surface. For those conditions the amount of produced hydrocarbon liquids was significantly reduced (down to about 60% of Fischer Assay). On the other hand, the quality of the produced oil was exceptionally high (mainly gasoline and kerosene). At the other extreme we have the case of the Fischer Assay determination itself. In that case the products are removed nearly as fast as they are generated and the residence time is reduced to nearly zero. The amount of oil thus generated is by definition 100% of Fischer Assay, but the quality of this liquid product is inferior to that of the liquid produced by the Swedish process.

In practice, the conditions of the Fischer Assay test cannot be approached in an in situ process where the liquid products always will be exposed for some finite time to high temperatures on their way to the production wells. Production of more than about 84% of Fischer Assay cannot be expected under any condition in an in situ oil shale process. However, the oil production rate can be reduced to the point that a liquid hydrocarbon of a desired quality is produced, and oil in the range of about 60–84% of Fischer Assay is recovered. Applicants have discovered that, in the present process, adjusting the quality of the produced oil to a desired level, and thus reducing the oil production rate, provides an additional advantage. By producing less oil we produce more gaseous hydrocarbons. In some applications it may be desirable to use the produced gas for the generation of electricity to be used for electric heaters in the injection wells. By proper adjustment of the oil production rate, the amount of gas required for running the power plant can be produced.

In the present process, it is not possible to obtain independently both a predetermined oil quality and a predetermined gas production rate. However, it may be feasible and desirable to control the rate of hydrocarbon production so that the amount of the produced hydrocarbons is about 60–84% of Fischer Assay, while the quality of the produced liquid hydrocarbons corresponds to an API gravity of about 35–50 degrees.

In various reservoir situations, portions of an oil shale deposit which would, in general, be suitable for use as a treatment interval, may be permeated by natural fractures and/or planes of weakness. The encountering of such relatively weak reservoir rocks is apt to be indicated by an inflow of water into wells drilled into such rocks. Such relatively weak rocks may undergo relatively long extensions of vertical fractures when pressurized fluids being displaced away from an injection well move into them. This may result in extending fluid passageways beyond the openings into production wells and/or into laterally adjacent aquifers capable of causing an inflow of water to an extent detrimental to the oil recovery process. In general, the natural fractures creating a relative weakness and/or water inflow can be thermally closed by a relatively mild heating.

Consequently, premature fracture extensions can be avoided by drilling and heating "guard wells" within such relatively weak oil shale zones in locations laterally surrounding a pattern of heat injecting and fluid producing wells and/or in locations intermittent between a heat injecting or fluid producing well and an adjacent aquifer. Such guard wells are used for conductively heating the adjoining formations substantially throughout the oil shale interval to be treated to a temperature which is too low to gasify significant proportions of the oil shale organic components but is high enough to cause a significant thermal expansion of the rocks. When those rocks are heated, the natural fractures are kept closed, and the fracturing caused by the approaching pressurized fluids (displaced away from heat-injecting wells) tends to be limited to horizontal fractures concentrated along the sides nearest to the heat-injecting wells. Where fluid producing wells are located substantially between the heat-injecting wells and the guard wells, the fractures are preferentially extended into those wells, where the high fluid pressures are quickly reduced by the production of the inflowing fluid.

In many oil shale deposits, the target formation is overlayed by natural aquifers. Natural fractures allow water to flow down into a target treatment interval, and this inflow of water could be detrimental to the process of the invention. In order to close these fractures, a buffer zone, some 20–100 feet in thickness, is created between the aquifer and the top of the treatment interval. Establishing a warm buffer zone between the treatment interval and th overlying aquifer will substantially isolate the aquifer from the treatment interval. The same concept applies to an aquifer located under the process zone. Cracks generated by the process, and natural fractures, can conduct produced fluids down into an aquifer, resulting in product loss. The heat required to establish a buffer zone may be provided through an appropriate design for a heat injection well. For example, where electric heaters are used, mild heating may be accomplished by designing the lead-in cables attached to the top of the heaters to dissipate a small amount of heat into the buffer zone.

Some oil shale deposits are surrounded on the periphery by shear cliffs which are substantially fractured, as evidenced by seasonal water outflow. Application of this invention in a standard field operation, starting at one end of such a deposit, could result in vertical fractures radiating outward from the active process zone, potentially connecting with the natural fracture system leading to the cliff face. A surrounding or adjacent aquifer would present a similar problem. In both circumstances, the operation of the invention is conducted in a manner which differs from standard field operations. The process is initiated in an area at or near the geometric center of the deposit, and the field is processed in successive bands, growing outwardly from the center of the deposit toward the edges of the deposit. By this procedure, fractures initially created will be too far from the edges of the deposit to intefere with aquifers or cliffs. As successive bands of the deposit are processed or retorted, the zone initially retorted, located on the inside, will be weaker and of greater permeability. This weaker, processed rock will offer relief to the tensile stresses and strains generated outside the process zone, and thus diminish the tendency to form outwardly growing fractures. Also, this zone of lower pressure and increased flow capacity will partly reduce the tendency of fluids to escape outwardly from the process zone and thus improve their confinement. The direction in which successive bands are processed is determined by stress and strain measuring devices located in observer wells between the edges of the process zone and the edges of the oil shale deposit. The major axis of the next band to be processed will be directed where the tensile stresses and strains are minimal in order to minimize the formation or extension of fractures from the heated treatment zone to areas beyond the periphery of the treatment interval.

The present process can advantageously be applied to an oil shale formation in which there is significant concentration of a mineral such as dawsonite or nahcolite. In such a formation the process provides a permeable zone from which such a mineral can be subsequently recovered. In addition, the present process is particularly advantageous in converting dawsonite to water-soluble compounds of aluminum (probably rho-alumina) which have been (both chemically and physically) made available for solution-mining to produce the aluminium—an essential material which is in short supply within the United States. In contrast to many previously proposed processes, the process of the present invention requires substantially no water, involves minimal land disruption, and can be conducted with minimal atmospheric pollution.

EXAMPLE 1

A series of injection and production wells is drilled into an oil shale formation 160 feet in thickness with 400 feet of overburden. The average oil grade of the interval is 20 gallons per ton as determined by Fischer assay.

The well pattern is a seven-spot with each heat injector at the corner of a regular hexagon surrounding a central producing well. The spacing is 75 feet between producers and injectors. The pattern repeats with producers sharing the injectors in each direction and continues to form a field-wide pattern capable of producing a large quantity of oil. The injector-to-producer ratio approaches 2 to 1 in a large field. In Example 1 the total oil production is 25,000 barrels per day throughout the life of the project.

In the injection wells, electrical heaters are installed inside a well casing cemented into the formation and connected to a power source on the surface. The production wells are equipped with standard oil field pumps for lifting the produced oil to the surface. The electrical injection rate is $3.23\times10^6$ BTU/well per day. The temperature of the injectors attains 750° C. The production wells reach a terminal temperature of 300° C. after 33–34 years of operation. Production over this period averages 5–6 barrels/day per well, with the average number of active producing wells being from about 4000 to 5000. Heat consumption is $1.1\times10^6$ BTU/barrel of liquid oil production.

Gaseous products collected from the production wells may be used for on-site generation of electricity or other purposes. The oil-phase petroleum which is so produced is superior to conventionally retorted shale oil. The relative rate of return which can be expected from the Example 1 situation is illustrated by the "Example 1" designation on FIG. 1.

EXAMPLE 2

A series of injection and production wells are drilled into an oil shale formation 750 feet in thickness with 1000 feet of overburden. The average grade of the oil shale interval is 26 gallons per ton as determined by Fischer assay.

The well pattern is the same seven-spot described in Example 1 except the spacing is 45 feet between the walls instead of 75 feet. Total production is 25,000 barrels/day throughout the life of the project. The injector to producer ratio still approaches 2 to 1. In the wells, the heaters and production equipment are similar to those described in Example 1.

The electrical injection rate is $10.55\times10^6$ BTU/well per day. The injection well temperatures reach 750° C. and the production wells reach a final temperature of 300° C. after a production life of 9–10 years. Production over this period averages 42–43 barrels/day per well, with the average number of active producing wells being about 600. The heat consumption is $5.6\times10^5$ BTU/barrel of liquid oil produced.

As in Example 1, gaseous products can be used for on-site power generation or other purposes and the liquid product will be higher in quality than conventionally retorted shale oil. The relative rate of return which can be expected is illustrated by the "Example 2" designation on FIG. 1.

Table 1 lists combinations of oil, shale grades, thicknesses and grade-thickness products which are generally suitable for use in the present process. The relative positions of such grade-thickness products with respect to the relative rates of financial return are illustrated by the designations "Preferred Range" and "Especially Preferred" on FIG. 1. In general, the higher the grade-thickness product the more desirable the deposit. The practical application of the process is limited only by the ability to heat the desired interval.

TABLE 1

| Grade (gallons/ton) | Thickness (feet) | Grade × Thickness |
|---|---|---|
| 30 | 100 | 3000 |
| 20 | 150 | 3000 |
| 10 | 300 | 3000 |
| More desirable grade thickness examples are shown as follows: | | |
| 30 | 500 | 15,000 |
| 25 | 200 | 5,000 |
| 20 | 1,000 | 20,000 |
| 15 | 2,000 | 30,000 |
| 10 | 750 | 7,500 |

As used herein regarding the grade of the portion of oil shale to be treated, the "average grade in gallons per ton by Fischer Assay" refers to the following: The determination is or is equivalent to a determination conducted substantially as described in the ASTM Standard Test Method D 3904-80. Crushed raw shale is sampled by riffle-splitting. The determination of the amount of oil plus gas equivalent available from oil shale is made by heating the raw shale from ambient temperature to 500° C. in cast aluminum-alloy retorts. The vapors distilled from the sample are cooled and the condensed fraction is collected. The oil and water fractions are separated, the water volume (converted to weight equivalent) is measured and subtracted from the oil plus water weight. The weight of uncondensable gases evolved (gas-plus-loss) is then calculated by difference. The grade, as used in the "grade times thickness in feet of oil shale" product, is the gallons of oil plus hydrocarbon gas equivalent corresponding to the total weight of oil plus hydrocarbon gas evolved by the heating.

FIELD TEST MEASUREMENTS

Tests were conducted in an outcropping of an oil shale formation which is typical of substantially impermeable and relatively thick oil shale deposits. Thirteen boreholes were drilled to depths between 20 and 40 feet and were arranged to provide a pattern of heat-injection, observation and fluid-production wells, with the boreholes being spaced about 2 feet apart in order to provide a relatively rapid acquisition of data. Heat was injected at a rate of about 300 watts per foot for five days. After the heat-injection well temperature had reached 450° C., a temperature fall-off test was run for one day.

Figure 3:
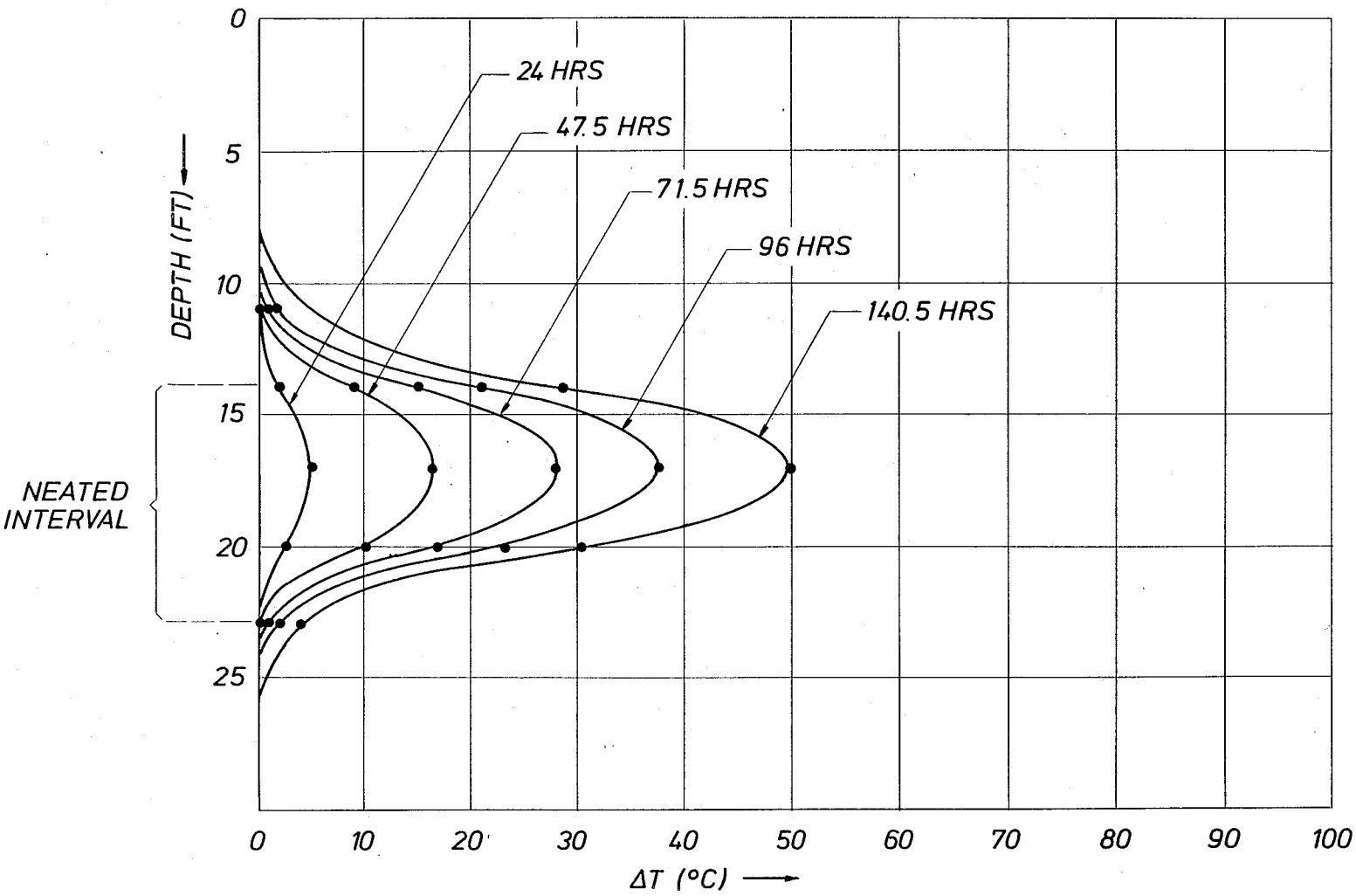
FIG. 3 illustrates a plot of thermal profiles at an observation well regarding temperatures measured at different depths and times within that well.

FIG. 3 shows the vertical thermal profiles in an observation well, as a function of time. The data was fitted to a mathematical solution describing the temperature distribution around a finite-length line source inside a medium of thermal conductivity (parallel to bedding) 3.25 mcal/cm-sec-°C. and thermal conductivity (perpendicular) 3.25 mcal/cm-sec-°C. The specific heat capacity utilized in the calculations was computed from the thermal conductivity, thermal diffusivity, and average bulk density of cores recovered during drilling of the wells. The thermophysical properties for the oil shale in which the tests were conducted are summarized in Table 2.

TABLE 2

| | |
|---|---|
| Initial Reservoir Temperature | 9.8° C. |
| Fischer Assay: | 20 gallon/ton |
| Bulk Density: | 2.20 gm/cm$^3$ |
| Thermal Diffusivity: | $6.6\times10^{-3}$ cm$^2$/sec |
| Specific Heat Capacity: | 0.224 cal/gm °C. |

Figure 4:
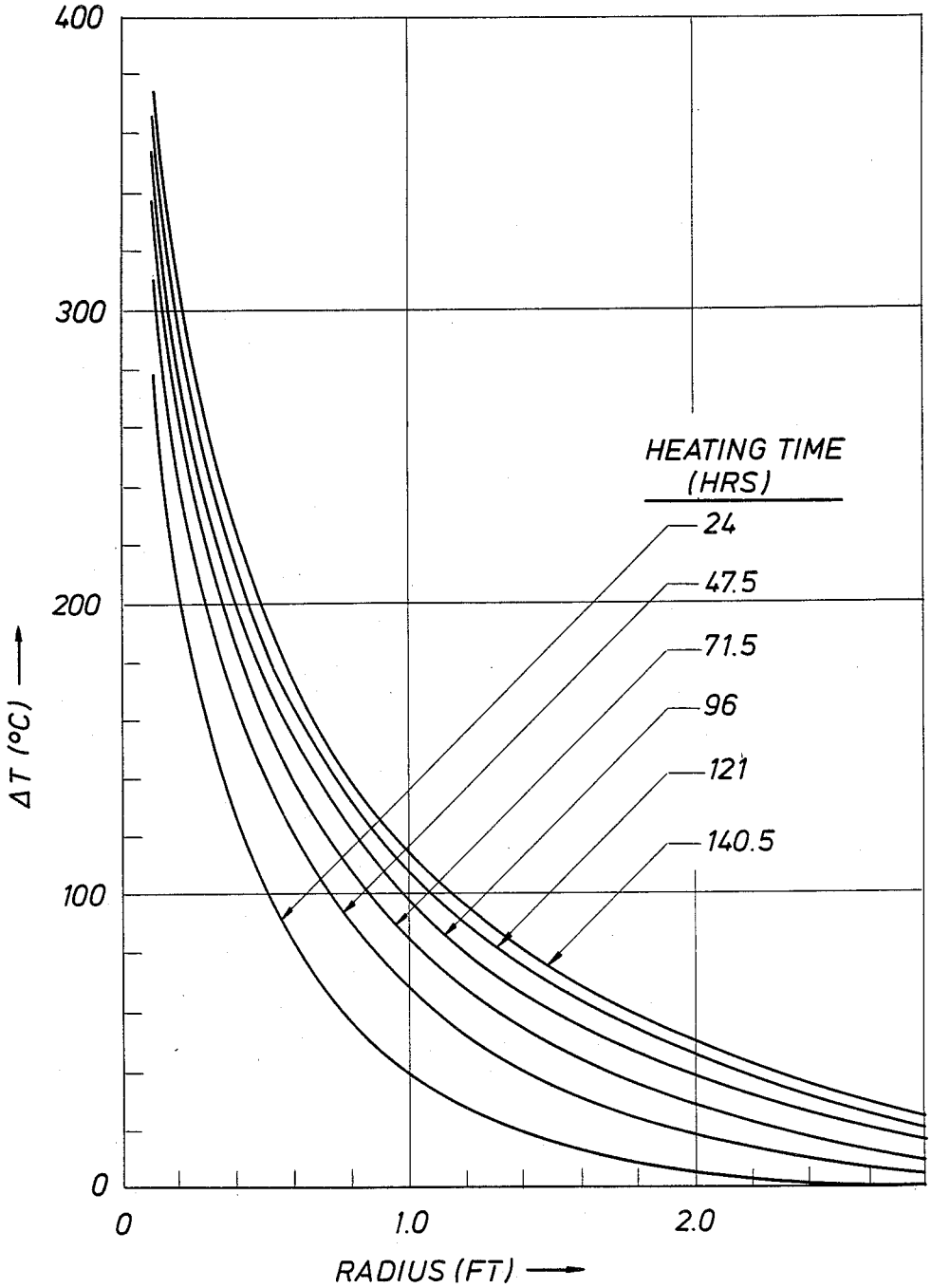
FIG. 4 is a plot of the radial thermal profiles at the middle of a heated zone after different times of heating.

FIG. 4 shows radial profiles computed for the middle of the heated zone for various heating times. At the end of a temperature buildup test of 140.5 hours, the average formation temperature between the heater and observation well was 120° C.

Figure 5:
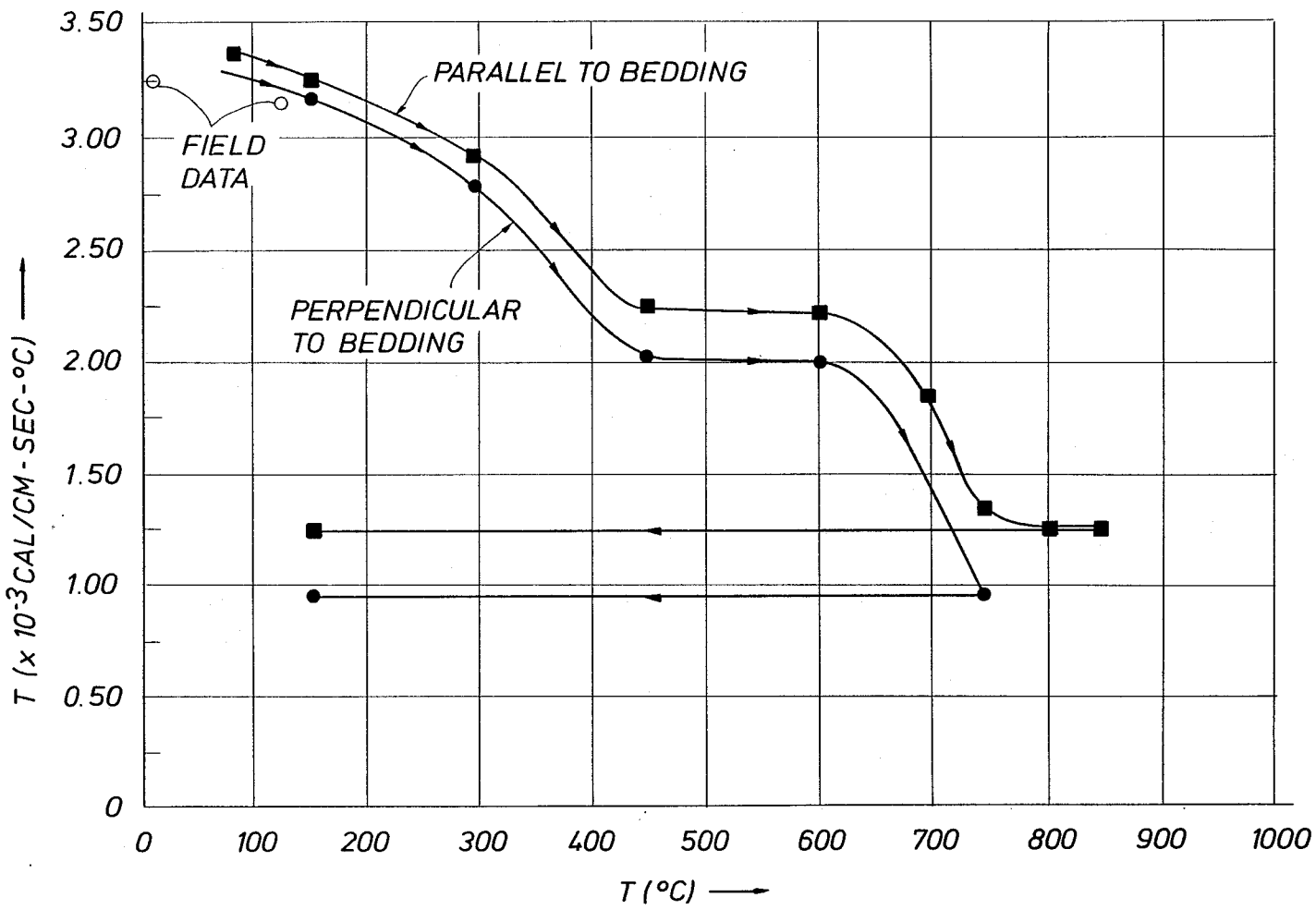
FIG. 5 is a plot of thermal conductivities parallel and perpendicular to the bedding planes of an oil shale as a function of temperature.

FIG. 5 shows a comparison of laboratory values and field data relative to the thermal conductivity parallel to and perpendicular to the bedding planes of the oil shale formation, as a function of temperature. The laboratory conductivity measurements were made on adjacent samples of cores from the observation well, using some cores cut parallel to and some cut perpendicular to the bedding planes. A nitrogen-atmosphere was used to eliminate oxidation reaction. The samples were constrained in the vertical direction but were free to expand radially. After the samples were heated to 800° C., the radial expansion averaged 1.45%. As shown in the figures, the laboratory values are in excellent agreement with the values computed from the field data. The tests indicate that the thermal conductivity is lower in the direction perpendicular to the bedding plane, because kerogen layers have a lower conductivity than the dolomite matrix. At temperatures below 100° C., the thermal conductivity is essentially isotropic, as observed in the field tests. But, that conductivity becomes increasingly anisotropic, as the kerogen is removed (at temperatures between 300 and 400° C.) and gas begins to occupy the spaces between the layers. Above 700° C., both the parallel and perpendicular conductivity decrease sharply due to the decomposition of the dolomite and evolution of $CO_2$.

Applicants discovered that when a substantially impermeable subterranean oil shale having the presently specified combination of grade and thickness was conductively heated as presently specified, a zone of permeability was developed between wells within the oil shale. Although the present invention is not premised on any particular mechanism, in the course of such a treatment the heated oil shale behaved as though it was subjected to a process for thermally inducing the formation of horizontal fractures. Such a behavior was not predictable, since the present process is operated without any injection of any fluid.

Fractures which are hydraulically induced within subterranean earth formations form along planes perpendicular to the least of the three principal compressive stresses (i.e., one vertical and two mutually perpendicular horizontal compressive stresses) which exist within any subterranean earth formation. However, where the hydraulic fractures tend to be vertical, horizontal fractures can be formed by injecting heated fluids so that the walls of the vertical fractures are heated until they swell shut. Then, by increasing the fluid injection pressure to greater than overburden pressure, a horizontal fracture can be formed. Such processes for thermally inducing the formation of horizontal fractures by injecting externally heated and pressurized fluids are described in patents such as U.S. Pat. No. 3,284,281, U.S. Pat. No. 3,455,391, and U.S. Pat. No. 3,613,785.

When a subterranean oil shale formation is heated the oil shale expands as the temperature increases. When the oil shale temperature reaches a kerogen pyrolyzing temperature (for example, from about 275–325° C.) additional expansion forces are generated. The kerogen is converted to fluids capable of occupying a larger volume than the kerogen, and such fluids become increasingly pressurized when the temperature is increased. As more fluid is formed and more fluid is heated, fractures are induced within the oil shale formation.

It appears that when the present process is operated within an impermeable oil shale, the in situ generation and displacement of heated and highly pressurized fluids occurs at the times and to the extents needed to successively extend and horizontally fracture through successive portions of the oil shale, when those portions become conductively heated. The zone being heated appears to undergo a relatively uniform, horizontal, radial expansion through the oil shale, at the rate set by the thermal conductivity of the oil shale. In each successive location in which a kerogen pyrolyzing temperature is reached, fluids appear to be formed, heated and pressurized so that substantially any vertical fractures which are formed within the heated zone are subsequently converted to horizontal fractures.

Applicants' tests indicated that substantially all of the fluid pyrolysis products of the oil shale tended to remain in or near the locations in which they were formed until they were displaced, through substantially horizontal fractures, into wells adjoining the heat-injecting wells. In addition, the fracture-inducting pressure of fluids in the horizontal fractures appears to have been reduced as those fluids expanded and were cooled as they moved away from the hottest portions of the heated zone.

Thus, the present process seems to induce the moving of a zone of kerogen-pyrolyzing temperatures through the oil shale immediately behind a zone of localized fracturing in which the fractures are, or soon become, horizontal fractures. The heating and fracturing zones seem to undergo a substantially uniform, horizontal, radial expansion through the oil shale, until the zone of fracturing reaches a location (such as the borehole of a production well) from which the oil shale pyrolysis products are withdrawn.

In addition, applicants have discovered that, at least where the overburden pressure is small, the zone of permeability that is created between adjacent wells retains a significantly high degree of permeability after the formations have cooled. Thus, it appears that, even if the overburden pressure is high, an application of the present process is capable of forming a well-interconnecting zone in which the permeability remains high or can be readily restored by an injection of fluid after some or all of the heat has dissipated. And, the degree and location of that permeability can be controlled by controlling the rate of removing fluid from the producing wells.

The data obtained by measurements in field tests of the type described above were inclusive of: the thermal conductivity of the oil shale formation, the amount of oil recoverable by Fischer analysis at various depths within heated intervals of the oil shale before and after heating, the measurement of the amount of pyrolysis products recovered, and the like. While no communication existed between heat injectors and producers at test start-up, injections at the end of the test demonstrated that permeable channels had formed. The results of standard engineering calculations were indicative of the applicability of a concept of the type described above to the results obtained by the tests.

Figure 6:
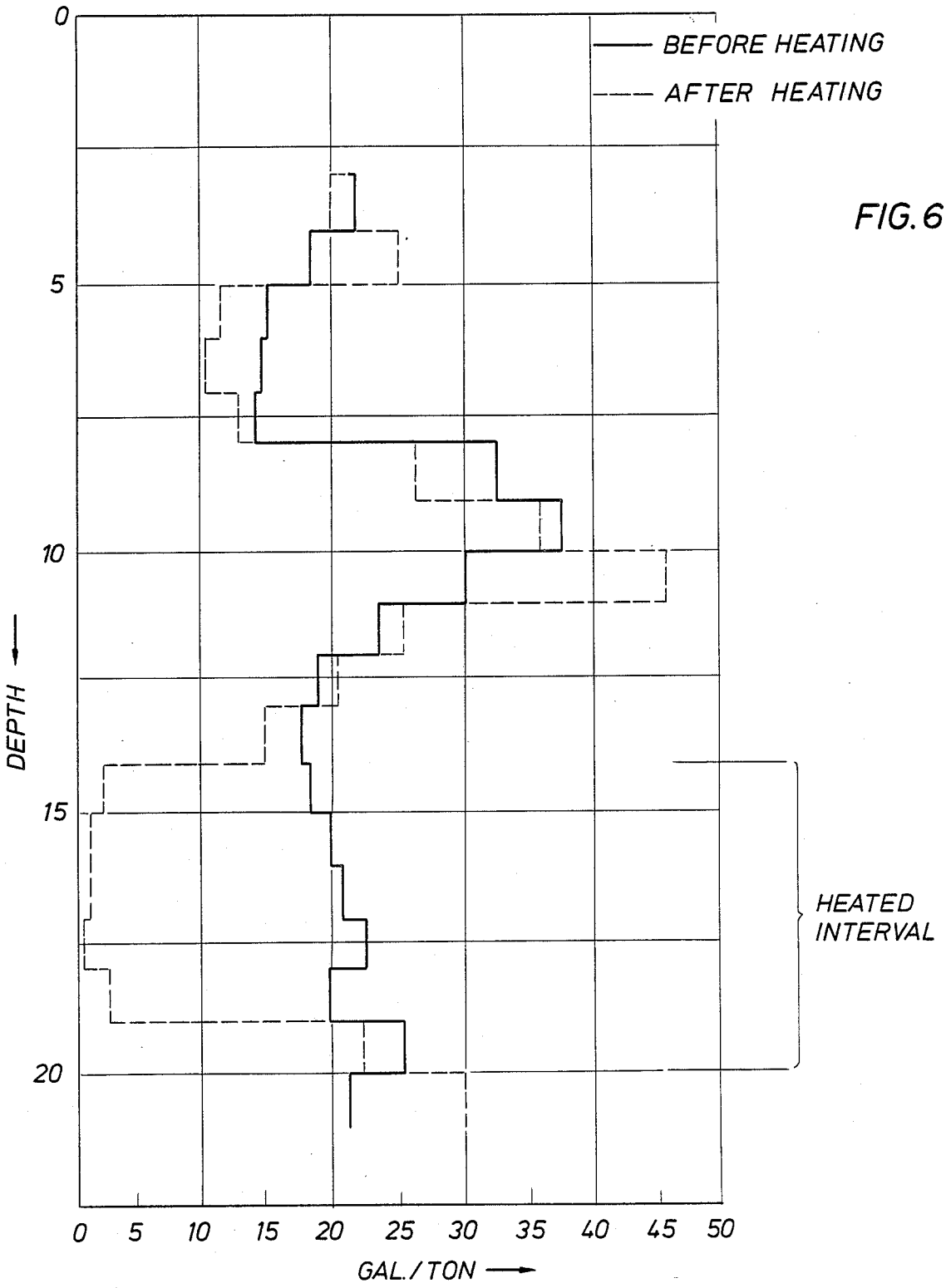
FIG. 6 is a graph of Fischer Assay yield with depth in and above a heated portion of subterranean oil shale.

FIG. 6 is a graph of Fischer Assay yields, from the target zone in the field test, as a function of depth. The heated interval extended from 14 to 20 feet. The solid curve shows the yields before the heating treatment and the dashed curve shows the yields after retorting was completed. The yields before and after were essentially the same outside the heated interval. The measurements were made on cores from the center of the pattern before heating and on cores about 6 inches away after heating. The variations which are apparent in those yields are within the normal limits of accuracy for the measuring of such values. Within the heated interval the Fischer Assay yield drops from an average of 20 gallons/ton before the test to less than 2 gallons/ton after heating. The retorting efficiency within the process zone was thus better than 90% of Fischer Assay.

The pattern and extent of the recovery confirms the fact that little oil was lost over the producing horizon through vertical fractures. In addition, the uniformity in retorting efficiency through the heated zone, indicates that thermal fronts were approximately uniform over most of the heated interval.

Figure 7:
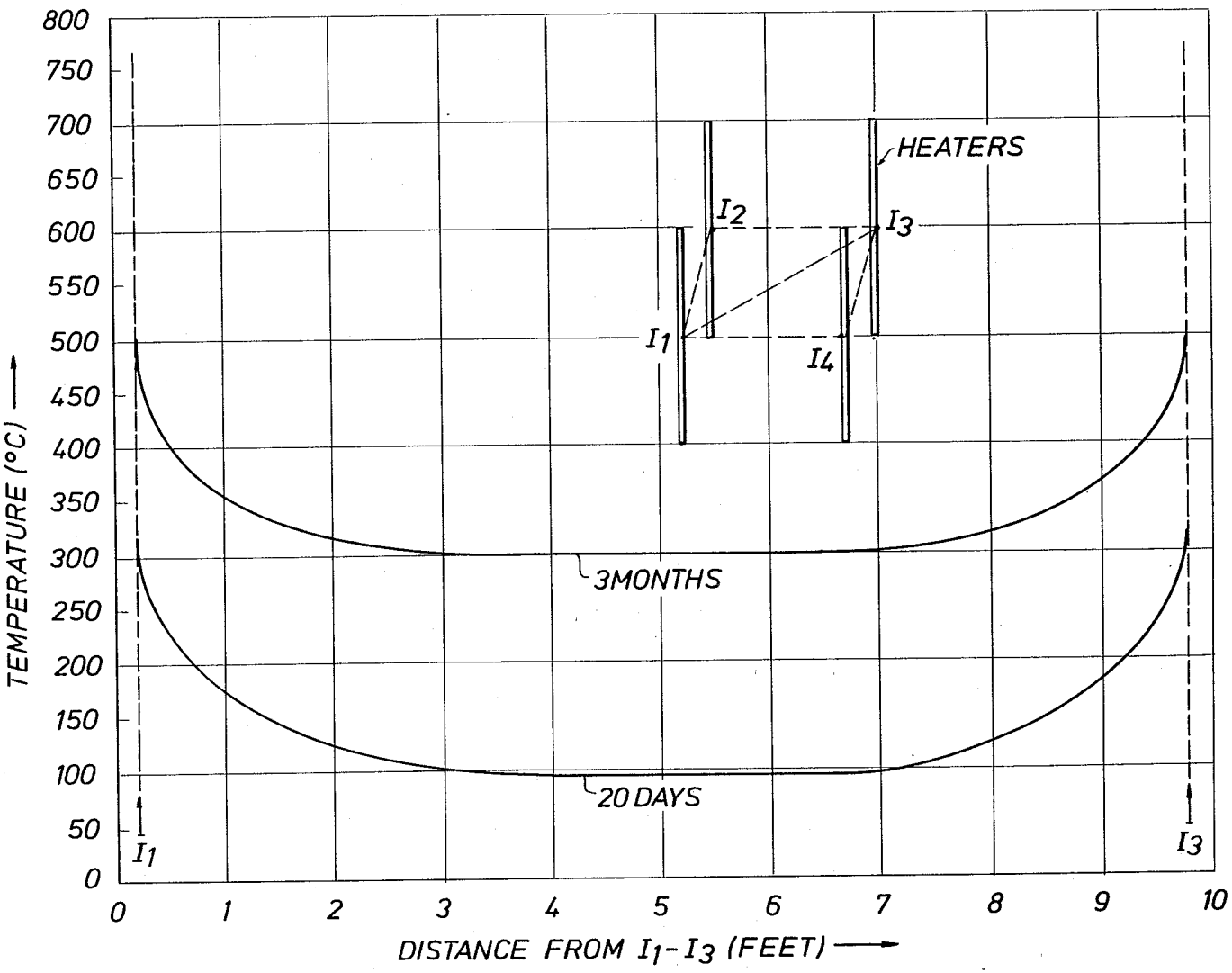
FIGS. 7 and 8 are plots of horizontal and vertical temperature profiles within a heated portion of subterranean oil shale formation.
Figure 8:
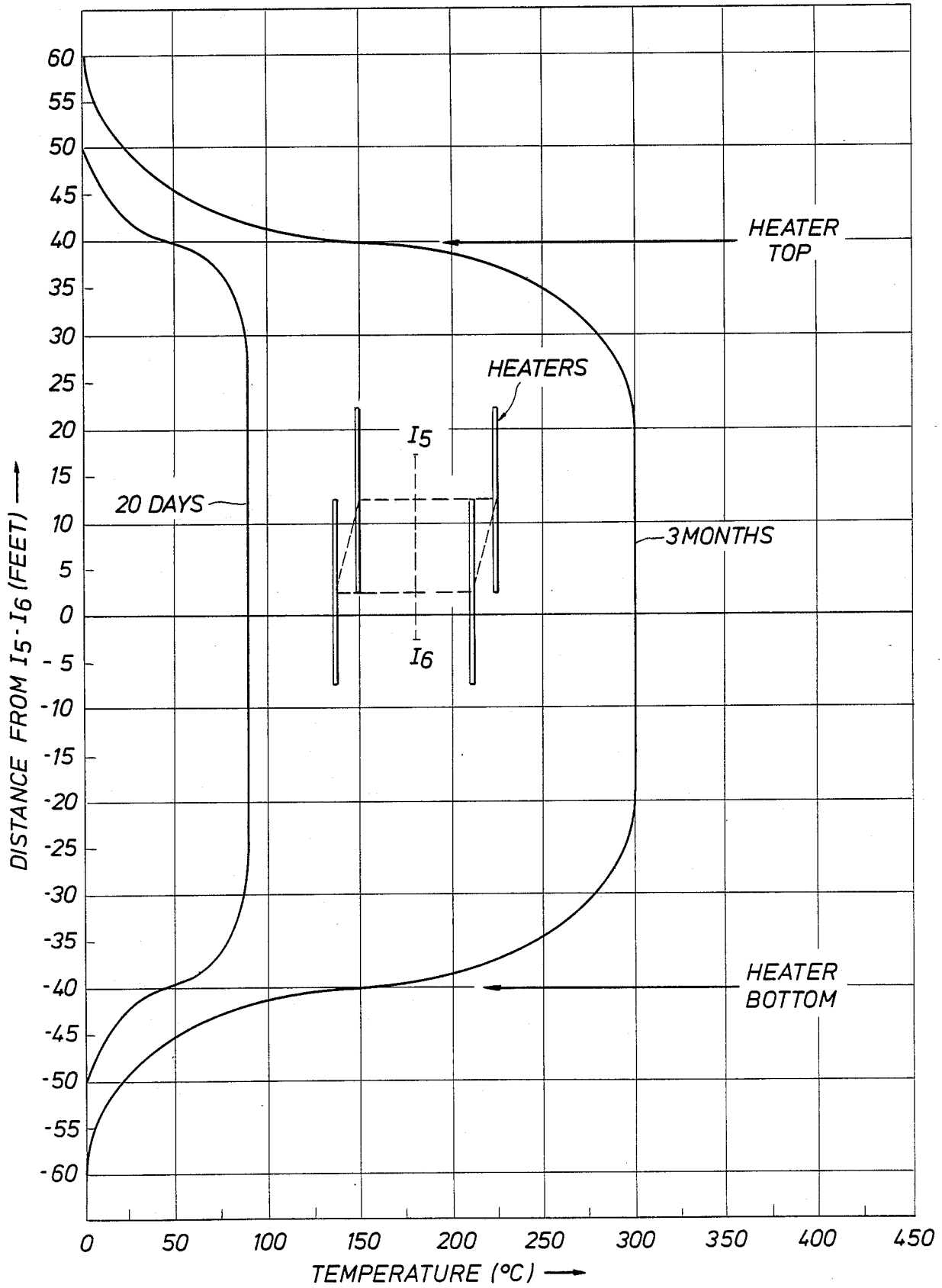

The uniformity of the thermal fronts is even more apparent in FIGS. 7 and 8. They show horizontal and vertical temperature profiles calculated, using field test data, for a set of vertical heaters in a five-spot square pattern. The set used in the calculations included four heat injectors and one center producer (not shown, but centered between the heaters shown on the figures). Each heater was assumed to be 80 feet long and heated at the rate of 230 watts per foot.

The profiles in FIG. 7 (graphs of temperature variations with distances from the heaters) were calculated along a horizontal segment $I_1I_3$ which extends through the mid-points of heaters at opposite corners of the square. FIG. 8 is a similar graph of profiles along a vertical segment $I_5I_6$ on the axis of symmetry of the pattern.

Such calculations indicate that by the time retorting temperatures (275–325° C.) are reached at the center of the pattern, more than 87% of its volume has been converted while only about 14% of the converted volume was heated to more than 325° C. Furthermore, the calculations indicate that if the power is turned off or reduced before the center reaches a target temperature such as 325° C., the leveling off of the thermal fronts will still heat the center of the pattern to retorting temperatures and will also reduce the temperature rise at the heaters. This mode of operation can ensure that less than 10% of the heated volume is heated to more than 325° C., and thus can increase the thermal efficiency of the process.

In view of the above test results and the calculations based on those results, it appears that, contrary to the prior teachings and beliefs, the initial impermeability of an oil shale deposit can be utilized as an advantage. The initial impermeability confines the fluids and fractures within the well pattern, since no permeability exists until the zone between the heat-injecting and fluid-producing wells becomes permeated by a pattern of heat-induced horizontal fractures.

What is claimed is:

1. In a process in which oil is produced from a subterranean oil shale deposit by extending at least one each of heat-injecting and fluid-producing wells into the deposit, establishing a heat-conductive fluid-impermeable barrier between the interior of each heat-injecting well and the adjacent deposit, and then heating the interior of each heat-injecting well at a temperature sufficient to conductively heat oil shale kerogen and cause pyrolysis products to form fractures within the oil shale deposit through which the pyrolysis products are displaced into at least one production well, an improvement for enhancing the uniformity of the heat fronts moving through the oil shale deposit, which comprises:

determining variations with depth in the composition and properties of the oil shale deposit;

completing said heat-injecting and fluid-producing wells selectively into a treatment interval of oil shale in which the oil shale deposit (a) is at least about 100 feet thick, (b) is substantially impermeable and free of mobile water, (c) has a composition and thickness such that the product of the average Fischer Assay grade times the thickness of the treatment interval is at least about 3,000 and (d) thereby contains components capable of interacting in a manner enhancing the uniformity of a front of conductively transmitted heat, with said wells being arranged so that, at least substantially throughout said treatment interval, the well boreholes are substantially parallel and are separated by substantially equal distances of about 30 to 100 feet; and within the interior of each heat-injecting well maintaining an average temperature which, selectively along said treatment interval, is at least about 600° C., but is not high enough to thermally damage equipment within the well, while heat is being transmitted away from the well at a rate not significantly faster than that permitted by the thermal conductivities of the earth formations adjacent to the heated interval within the well.

2. The process of claim 1 in which, to the extent required to keep the rate at which heat is transmitted through the oil shale deposit substantially uniform along the axes of the heated interval of the heat-injecting well, the temperature at which at least one heat-injecting well is heated is relatively higher at depths adjacent to portions of the oil shale deposit in which the heat conductivities are relatively lower.

3. The process of claim 1 in which the rate of heating the interior of at least one heat-injecting well is varied to an extent causing an effective leveling off of the thermal front so that the rate of advance through the oil shale of the thermal front is continued at substantially the same rate while the rate of increase of the temperature within the borehole is significantly reduced.

4. The process of claim 1 in which the heat-injecting and fluid-producing wells are arranged in a series of contiguous patterns in which each fluid-producing well is surrounded by at least four heat-injecting wells.

5. The process of claim 4 in which each fluid-producing well is surrounded by twelve heat-injecting wells.

6. The process of claim 1 in which the oil shale grade is at least about 20 gallons per ton and the grade-thickness product is at least about 15,000.

7. The process of claim 1 in which at least one well located near an edge of a pattern of heat-injecting and fluid-producing wells is extended substantially throughout the treatment interval and heated at a temperature high enough to cause a thermal expanding and/or compressive stressing of the adjacent earth formations but low enough to avoid significant thermal mobilization of organic components of the oil shale.

8. The process of claim 1 in which at least one so heated well is subsequently heated at about the temperature selected for the heating of the heat-injecting wells being employed.

9. The process of claim 1 in which a warm, fluid-impermeable barrier is established in a buffer zone between the treatment interval of oil shale and an adjacent interval containing mobile water.

10. The process of claim 1 in which a warm, fluid-impermeable barrier is established in a buffer zone, between the treatment interval of oil shale and an adjacent interval containing mobile water, by heating the buffer zone sufficient to cause thermal expansion, and to substantially close fractures, within the buffer zone, without pyrolyzing any organic components present in the buffer zone.

11. The process of claim 10 in which the fluid-impermeable barrier is established above the oil shale treatment interval.

12. The process of claim 10 in which the fluid-impermeable barrier is established below the oil shale treatment interval.

13. A process for heating an initially substantially impermeable subterranean oil shale formation so that oil is subsequently produced from the formation comprising:

completing at least two wells into a subterranean oil shale-containing treatment interval which is substantially impermeable, contains substantially no mobile water, is at least about 100 feet thick, is, capable of confining fluid at a pressure sufficient to form a localized horizontal fracture within the treatment interval and contains a Fischer Assay grade and thickness of oil shale such that the average grade times the thickness in feet of the oil shale is at least about 3000;

arranging said wells to provide at least one heat-injecting and at least one fluid-producing well having boreholes which, substantially throughout the treatment interval, are substantially parallel and are separated by substantially equal distances of at least about 20 feet;

in each heat-injecting well, substantially throughout the treatment interval, sealing the face of the oil shale formation with a solid material which is relatively heat-conductive and substantially fluid impermeable;

in at least one heat-injecting well increasing the effective diameter of the borehole in at least one portion of the treatment interval and extending at least one heat-conductive metal element from within the interior of the borehole to near the face of the so-enlarged portion of the borehole;

in each fluid-producing well, substantially throughout the treatment interval, establishing fluid communication between the wellbore and the oil shale formation and arranging the well for producing fluid from the oil shale formation; and heating the interior of each heat-injecting well, at least substantially throughout the treatment interval, at a rate or rates capable of (a) increasing the temperature within the borehole interior to at least about 600° C. and (b) maintaining a borehole interior temperature of at least about 600° C. without causing it to become high enough to thermally damage equipment within the borehole while heat is being transmitted away from the borehole at a rate not significantly faster than that permitted by the thermal conductivity of the oil shale formation.

14. The process of claim 13 in which the material sealing the face of the oil shale formation along the borehole of a heat-injecting well is a cement arranged to fill substantially all of the space between the outermost metallic elements within the interior of the borehole and the face of the oil shale formation, with said cement having a thermal conductivity at least substantially as high as that of the oil shale formation.

15. The process of claim 13 in which the rate of heating the interior of at least one heat-injecting well is varied to an extent causing an effective leveling off of the thermal front so that the rate of advance through the oil shale of the thermal front is continued at substantially the same rate while the rate of increase of the substantially within the borehole is significantly reduced.

16. The process of claim 13 in which the heat-injecting and fluid-producing wells are arranged in a series of contiguous patterns in which each fluid-producing well is surrounded by at least four heat-injecting wells.

17. The process of claim 16 in which each fluid-producing well is surrounded by twelve heat-injecting wells.

18. The process of claim 13 in which the oil shale grade is at least about 20 gallons per ton and the grade-thickness product is at least about 15,000.

19. The process of claim 13 in which a warm, fluid-impermeable barrier is established in a buffer zone between the treatment interval of oil shale and an adjacent interval containing mobile water.

20. In a process in which oil is produced from a subterranean oil shale deposit by extending at least one each of heat-injecting and fluid-producing wells into the deposit, establishing a heat-conductive fluid-impermeable barrier between the interior of each heat-injecting well and the adjacent deposit, and then heating the interior of each heat-injecting well at a temperature sufficient to conductively heat oil shale kerogen and cause pyrolysis products to form fractures within the oil shale deposit through which the pyrolysis products are displaced into at least one production well, an improvement for maintaining the uniformity of the heat fronts moving through the oil shale deposit, which comprises:

determining variations with depth in the composition and properties of the oil shale deposit;

completing said heat-injecting and fluid-producing wells selectively into a treatment interval of oil shale in which the oil shale deposit (a) is at least about 100 feet thick, (b) is substantially impermeable and free of mobile water, and (c) has a composition and thickness which is capable of maintaining the uniformity of a front of conductively transmitted heat;

arranging said wells so that, at least substantially throughout said treatment interval, the well boreholes are at least relatively parallel and are separated by at least relatively equal distances of about 30 to 100 feet;

within the interior of each heat-injecting well maintaining an average temperature which, selectively along said treatment interval, is at least about 600° C., but is not high enough to thermally damage equipment within the well, while heat is being transmitted away from the well at a rate not significantly faster than that permitted by the thermal conductivities of the earth formations adjacent to the heated interval within the well; and in at least one fluid-producing well, restricting the rate at which fluid is produced so that the quality of liquid hydrocarbons produced is significantly higher than the quality that would be produced if the liquids were allowed to flow at a higher rate.

21. The process of claim 20 in which a warm, fluid-impermeable barrier is established in a buffer zone between the target treatment interval of oil shale and an adjacent interval containing mobile water.

22. A process for exploiting a target oil shale interval, by progressively expanding a heated treatment zone band from about a geometric center of the target oil shale interval outward, such that the formation or extension of vertical fractures from the heated treatment zone band to the periphery of the target oil shale interval is minimized.

23. The process of claim 22 in which the formation or extension of vertical fractures from the heated treatment zone band to beyond the periphery of the target oil shale interval is minimized by preferentially expanding the heated treatment band in the direction of least tensile stress or strain within the target oil shale interval.

24. A process for producing kerogen products from a subterranean oil shale formation comprising:

extending at least one heat-injecting well and at least one fluid-producing well into a treatment interval within the oil shale formation;

establishing a warm, fluid-impermeable barrier between the treatment interval of oil shale and an adjacent interval containing mobile water, such that an influx of mobile water into the treatment interval is prevented;

heating the interior of each heat-injecting well, at a depth adjacent to the treatment interval, to a high temperature;

conductively heating the treatment interval adjacent to at least one heat-injection well, sufficient to pyrolyze the kerogen present, initiate fractures, and displace kerogen pyrolysis products within the treatment interval; and producing the kerogen pyrolysis products from at least one fluid-producing well.

25. The process of claim 24 in which the warm, fluid-impermeable barrier is established in a buffer zone, between the treatment interval of oil shale, and an interval containing mobile water that is adjacent to the treatment interval on a vertical axis, by heating the buffer zone sufficient to cause thermal expansion that substantially closes fractures within the buffer zone, without pyrolyzing any organic components present in the buffer zone.

26. The process of claim 24 in which (a) the warm, fluid-impermeable barrier is established in a guard well zone, between the treatment interval of oil shale and a laterally adjacent are containing mobile water, by heating the guard well zone sufficient to cause thermal expansion that substantially closes fractures within the guard well zone, without pyrolyzing any organic components present in the guard well zone.

27. The process of claim 24 in which the conductive heating is continued sufficiently long to produce the kerogen pyrolysis products from at least one fluid-producing well.

28. The process of claim 24 in which the temperature to which the interior of the heat-injecting well is heated, is varied in conjunction with thermal conductivity values along the depth of the treatment interval, sufficient to conductively heat the treatment interval at a substantially uniform rate.

29. The process of claim 24 in which the diameter of a borehole for at least one heat-injecting well in at least one portion of the treatment interval is increased, and at least one heat-conductive metal element is extended from within the borehole to near a face of the enlarged portion of the borehole.

30. The process of claim 24 in which the rate of production of kerogen pyrolysis products from at least one fluid-producing well is restricted, such that the quality of products produced is significantly higher than the quality of products produced at an unrestricted rate.

31. The process of claim 24 in which the production of kerogen pyrolysis products is followed by solution mining to remove aluminum present in the pyrolyzed oil shale treatment interval.

32. A process for producing kerogen products from a subterranean oil shale formation comprising:

selecting an oil shale treatment interval which (a) is at least about 100 feet thick and (b) has a composition and thickness such that the product of the Fischer Assay grade and the thickness of the treatment interval is at least about 3,000;

extending at least one heat-injecting well and at least one fluid-producing well into a treatment interval within the oil shale formation;

arranging the wells to be separated by substantially equal distances of about 30 to 100 feet;

heating the interior of each heat-injecting well, at a depth adjacent to the treatment interval, to a temperature of at least about 600° C., wherein, to the extent required to keep the rate at which heat is transmitted through the oil shale deposit substantially uniform along the axes of the heated interval of the heat-injecting well, the temperature at which at least one heat-injecting well is heated is relatively higher at depths adjacent to portions of the oil shale deposit in which the heat conductivities are relatively lower;

conductively heating the treatment interval adjacent to at least one heat-injecting well, sufficient to pyrolyze the kerogen present, initiate fractures, and displace kerogen pyrolysis products within the treatment interval; and producing the kerogen pyrolysis products from at least one fluid-producing well.

33. The process of claim 32 wherein the oil shale treatment interval has a composition and thickness such that the product of the Fischer Assay grade and the thickness of the treatment interval is at least 15,000.

34. A process for producing kerogen products from a subterranean oil shale formation comprising:

selecting an oil shale treatment interval which (a) is at least about 100 feet thick and (b) has a composition and thickness such that the product of the Fischer Assay grade and the thickness of the treatment interval is at least about 3,000;

extending at least one heat-injecting well and at least one fluid-producing well into a treatment interval within the oil shale formation;

arranging the wells to be separated by substantially equal distances of about 30 to 100 feet throughout the treatment interval;

heating the interior of each heat-injecting well, at a depth adjacent to the treatment interval, to a temperature of at least about 600° C., wherein the rate of heating the interior of at least one heat-injecting well is varied to an extent causing an effective leveling off of the thermal front so that the rate of advance through the oil shale of the thermal front is continued at substantially the same rate while the rate of increase of the temperature within the borehole is significantly reduced;

conductively heating the treatment interval adjacent to at least one heat-injecting well, sufficient to pyrolyze the kerogen present, initiate fractures, and displace kerogen pyrolysis products within the treatment interval; and producing the kerogen pyrolysis products from at least one fluid-producing well.

35. The process of claim 34 wherein the oil shale treatment interval has a composition and thickness such that the product of the Fischer Assay grade and the thickness of the treatment interval is at least 15,000.

36. A process for producing kerogen products from a subterranean oil shale formation comprising:

selecting an oil shale treatment interval which (a) is at least about 100 feet thick and (b) has a composition and thickness such that the product of the Fischer Assay grade and the thickness of the treatment interval is at least about 3,000;

extending at least one heat-injecting well and at least one fluid-producing well into a treatment interval within the oil shale formation;

arranging the wells to be separated by substantially equal distances of about 30 to 100 feet throughout the treatment interval;

establishing a relatively heat-conductive and substantially fluid-impermeable barrier between the interior of each heat-injecting well and the adjacent treatment interval;

heating the interior of each heat-injecting well, at a depth adjacent to the treatment interval, to a temperature of at least about 600° C., wherein, to the extent required to keep the rate at which heat is transmitted through the oil shale deposit substantially uniform along the axes of the heated interval of the heat-injecting well, the temperature at which at least one heat-injecting well is heated is relatively higher at depths adjacent to portions of the oil shale deposit in which the heat conductivities are relatively lower;

conductively heating the treatment interval adjacent to at least one heat-injecting well, sufficient to pyrolyze the kerogen present, initiate fractures, and displace kerogen pyrolysis products within the treatment interval; and producing the kerogen pyrolysis products from at least one fluid-producing well.

37. The process of claim 36 wherein the oil shale treatment interval has a composition and thickness such that the product of the Fischer Assay grade and the thickness of the treatment interval is at least 15,000.

38. A process for producing kerogen products from a subterranean oil shale formation comprising:

selecting an oil shale treatment interval which (a) is at least about 100 feet thick and (b) has a composition and thickness such that the product of the Fischer Assay grade and the thickness of the treatment interval is at least about 3,000;

extending at least one heat-injecting well and at least one fluid-producing well into a treatment interval within the oil shale formation;

arranging the wells to be separated by substantially equal distances of about 30 to 100 feet throughout the treatment interval;

establishing a relatively heat-conductive and substantially fluid-impermeable barrier between the interior of each heat-injecting well and the adjacent treatment interval;

heating the interior of each heat-injecting well, at a depth adjacent to the treatment interval, to a temperature of at least about 600° C., wherein the rate of heating the interior of at least one heat-injecting well is varied to an extent causing an effective leveling off of the thermal front so that the rate of advance through the oil shale of the thermal front is continued at substantially the same rate while the rate of increase of the temperature within the borehole is significantly reduced;

conductively heating the treatment interval adjacent to at least one heat-injecting well, sufficient to pyrolyze the kerogen present, initiate fractures, and displace kerogen pyrolysis products within the treatment interval; and producing the kerogen pyrolysis products from at least one fluid-producing well.

39. The process of claim 38 wherein the oil shale treatment interval has a composition and thickness such that the product of the Fischer Assay grade and the thickness of the treatment interval is at least 15,000.

* * * * *